United States Patent [19]

Waters

[11] Patent Number: 4,526,652

[45] Date of Patent: Jul. 2, 1985

[54] DANDY ROLL FOR MANUFACTURING PAPER HAVING SIMULATED OXFORD CLOTH WATERMARK AND RELATED METHOD FOR PAPERMAKING

[75] Inventor: James R. Waters, Appleton, Wis.

[73] Assignee: The Mead Corporation, Dayton, Ohio

[21] Appl. No.: 553,003

[22] Filed: Nov. 17, 1983

[51] Int. Cl.[3] ..... D21F 1/46

[52] U.S. Cl. ..... 162/110; 162/314; 29/121.3

[58] Field of Search ..... 162/110, 314; 29/121.3

[56] References Cited

U.S. PATENT DOCUMENTS

| | | | |
|---|---|---|---|
| 353,666 | 12/1986 | Crane, Jr. . | |
| 1,196,181 | 8/1946 | Tompkins et al. . | |
| 1,571,715 | 2/1926 | Fearing . | |
| 1,616,222 | 2/1927 | Harrigan . | |
| 1,752,311 | 4/1930 | Trotman | 29/121.3 |
| 1,866,811 | 7/1932 | Croix . | |
| 3,020,168 | 2/1962 | Gouveia . | |

FOREIGN PATENT DOCUMENTS

| | | | |
|---|---|---|---|
| 2698 | of 1877 | United Kingdom | 162/110 |

*Primary Examiner*—William Smith

*Attorney, Agent, or Firm*—Biebel, French & Nauman

[57] ABSTRACT

A dandy roll useful in producing paper bearing a watermark which simulates oxford cloth and a papermaking process using the same are disclosed.

12 Claims, 4 Drawing Figures

DANDY ROLL FOR MANUFACTURING PAPER HAVING SIMULATED OXFORD CLOTH WATERMARK AND RELATED METHOD FOR PAPERMAKING

BACKGROUND OF THE INVENTION

The present invention relates to a dandy roll useful in producing paper having a watermark which simulates oxford cloth.

In papermaking, watermarks are conventionally formed by contacting the paper stock while it is still damp with a dandy roll having raised and/or recessed areas on the surface. An opaque mark known as a "shaded mark" if formed on the paper in areas contacting the recesses on the surface of the dandy roll and is the result of pulp fibers accumulating in the recesses as the paper stock travels under the dandy roll on the papermaking machine. Translucent marks, known as "wire marks," are formed in the paper in areas contacting the raised areas on the surface of the dandy roll. These marks are the result of the raised surface of the roll displacing the fibers in the stock resulting in areas in which the fibers are less concentrated and the paper is more translucent.

It is conventional in the art to form shaded marks by depressing the surface of the wire screen forming the dandy roll and to form wire marks by soldering wire segments, known as electro wires, to the surface of the dandy roll screen. See, for example, U.S. Pat. No. 353,666 to Z. Crane, Jr. (1886) and U.S. Pat. No. 1,571,715 to Fearing (1926). It has also been known to watermark paper by altering the drainage rate of the Fourdrinier screen by modifying the weave in the screen such as by using larger gauge wire to form the screen or by omitting a wire from the screen altogether. See, for example, U.S. Pat. No. 1,616,222 to Harrigan (1927).

SUMMARY OF THE INVENTION

An object of the present invention is to provide a dandy roll which is useful in manufacturing paper bearing a watermark which simulates oxford cloth.

A further object of the present invention is to provide a process for producing paper which carries a watermark simulating oxford cloth.

These and other objects of the present invention will become apparent from the following description of the invention.

DETAILED DESCRIPTION OF THE INVENTION

Figure 1:
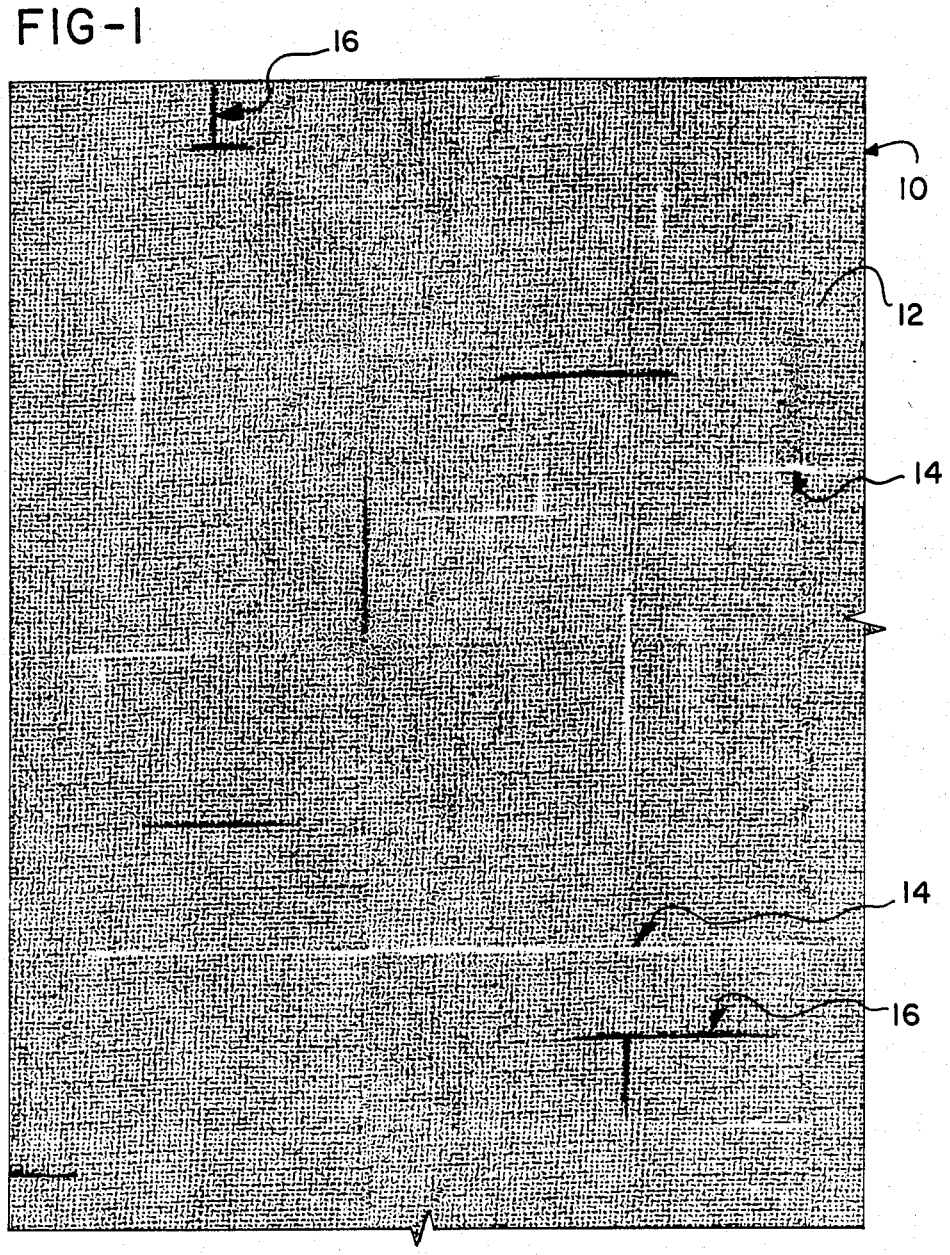
FIG. 1 is an overview of a sheet of paper manufactured in accordance with the present invention bearing a simulated oxford cloth watermark.
Figure 2:
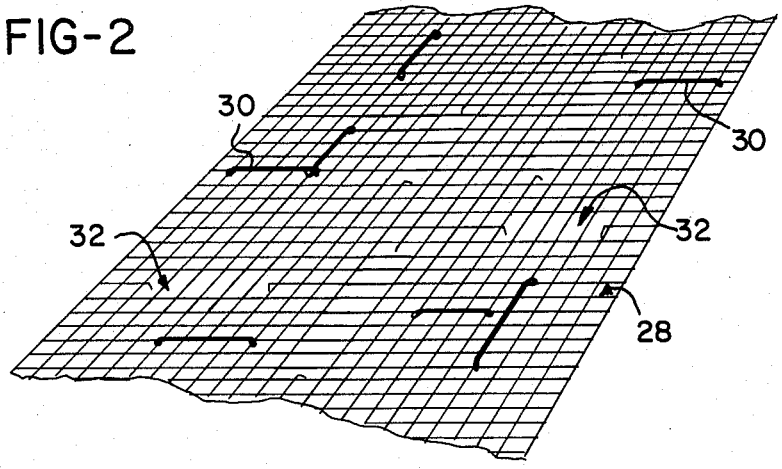
FIG. 2 is a partial overhead view of a dandy roll screen in accordance with the present invention.

FIG. 1 is illustrative of a paper bearing the type of watermark produced in accordance with the present invention.

In FIG. 1, a paper sheet 10 is shown bearing a watermark which simulates oxford cloth. The simulated weave is made up of a woven background pattern 12 which has simulated "imperfections" therein in the form of translucent lines 14 and opaque lines 16. These lines are arranged to simulate the variations which are normally observed in oxford cloth due to variations in the fibers, the weave and dye. In addition to the simulated weave, the paper may bear one or more conventional watermarks such as the name of a paper manufacturer, a company logo, or the like.

Figure 4:
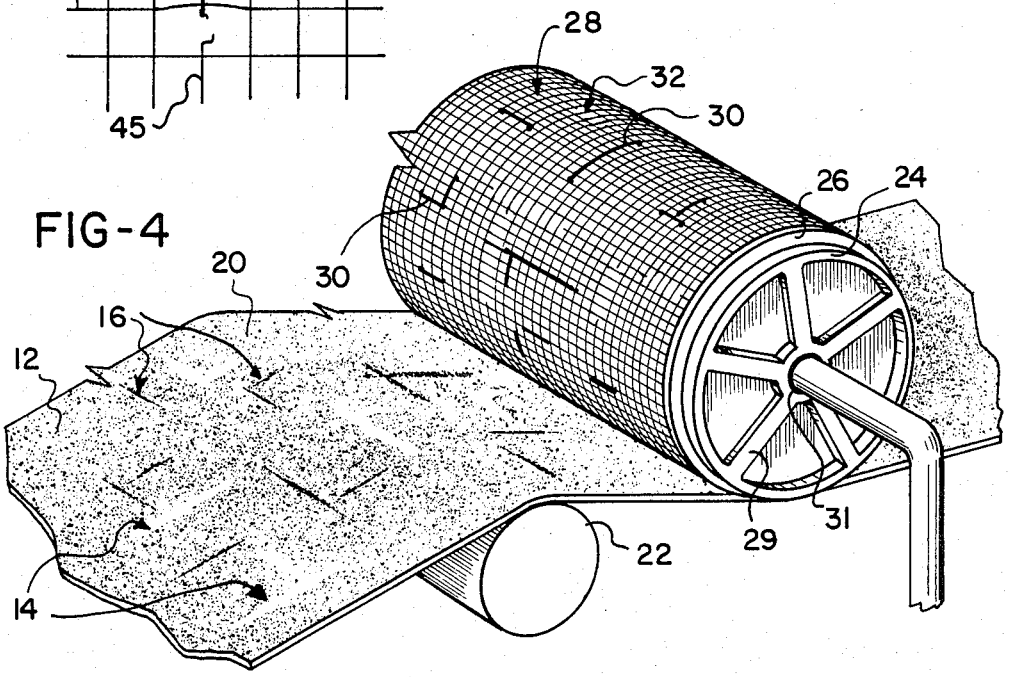
FIG. 4 is a perspective view of a dandy roll in accordance with the present invention on a conventional papermaking machine.

The paper of FIG. 1 is manufactured using the dandy roll of the present invention in conjunction with standard papermaking techniques. The dandy roll is usually positioned near the end of the papermaking machine where the paper stock leaves the wire, as is conventional in the art. At this point, the stock is sufficiently damp that the fibers forming the paper can be displaced by the surface of the dandy roll. A typical arrangement is shown in FIG. 4 where paper web 20 is supported on a table of rollers 22 as it passes into contact with the dandy roll 24.

The dandy roll is constructed of a cylindrical frame 26 which is wrapped with a wire screen 28. The frame is constructed in a conventional manner. Typically, a spiral truss wire (not shown) is wound in either clockwise or counter-clockwise direction between two spidered heads 29 (one shown) on each end of the dandy roll. Longitudinal wires (not shown) are then typically soldered across the length of the roll between the spidered heads. Another truss wire is then spirally wound around the circumference of the roll in the direction opposite the winding of the first truss wire to provide rigidity to the cylindrical frame. Each spidered head has a journal (31) protruding from its center which holds the dandy roll in place on the papermaking machine. These journals are not necessary if the dandy roll is mounted with a trunnion drive. In this case, the dandy heads are not spidered but have a concave groove around each open head which matches the trunnion drive wheel. The wire mesh cover 28 is affixed to the cylindrical frame by soldering to the frame heads and seaming the edges of the screen across the length of the roll. The screen 28 is positioned on the dandy roll with its wires running longitudinally and circumferentially of the roll.

To produce a watermark which simulates oxford cloth, the wire screen used on the dandy roll is preferably formed with a larger mesh and from larger diameter wire than the screens conventionally used on dandy rolls. Conventional dandy rolls are designed to smooth the paper and are constructed with screens having a relatively small mesh (e.g., 35 to 40 mesh) which does not mark the paper. By using a larger mesh and a larger wire in the present invention, a composite watermark having translucent and opaque points is imparted to the paper which simulates a textile weave.

In accordance with preferred embodiments of the present invention, the dandy roll screen meash is in the range of about 10 to 30 mesh with screens ranging from about 15 to 25 mesh being most preferred. These screens are usually formed from wires ranging from about 0.014 to 0.020 inch in diameter.

As is commonly known, oxford cloth does not have a perfectly uniform appearance but contains imperfections or variations due to variations in the fibers and/or weave. In accordance with the present invention, simulated imperfections are reproduced in the watermark as randomly distributed short, substantially straight, shaded marks 16 and wire marks 14.

To produce the wiremarks 14, a plurality of substantially straight electro wires 30 is soldered to the surface of the dandy roll screen 28. These electro wires are randomly positioned on the dandy roll screen to run in the same direction as the wires forming the screen. The wire segments 30 are preferably the same diameter as the wire forming the screen 28. The length of the segments 30 will vary with the artist's conception of oxford cloth, but they will usually range from about 0.5 to 2 inches.

The shaded marks 16 are formed by pockets 32 in the dandy roll screen 28. Conventionally, recesses useful in forming shaded marks are formed in dandy roll screens by annealing the screen and locally deforming the screen to produce a recess by die-pressing. This technique cannot be used in simulating oxford cloth because the shaded mark which results is two to three times wider than the screen mesh. This is substantially broader than a typical oxford cloth imperfection. It is also a disadvantageous technique because the wire screen must be removed from the dandy roll to produce the recess. Accordingly, it was necessary to develop a means for producing recesses suitable for forming narrow shaded marks to accomplish the present invention.

Figure 3:
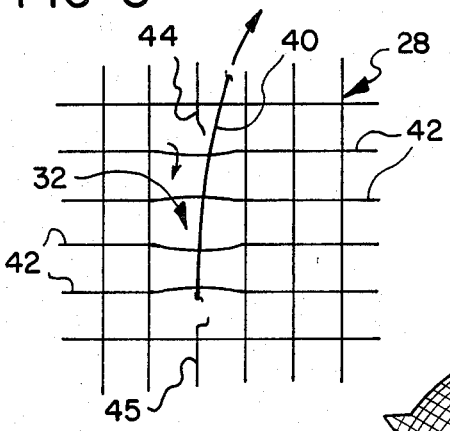
FIG. 3 is an expanded view of the dandy roll screen of FIG. 2 showing the surface modification used to form shaded marks.

In accordance with the present invention, narrow pockets 32 useful in simulating oxford imperfections are formed in the dandy roll screen by removing a segment of the wire forming the screen as shown in FIG. 3. This is accomplished by cutting the segment 40, which ranges from approximately 0.5 to 2 inch, from the screen and removing it. The ends 44 of the wire 45 having the segment 40 removed are pushed firmly into the wire screen so that pick outs will not occur as the dandy roll rides the paper stock. The screen forming wires 42 intersecting the removed segment 40 are left intact and an elongated pocket 32 is thereby provided in the space left by the removed segment which collects fiber. This produces a shaded mark which is of approximately the same width as the mesh of the wire screen.

By randomly arranging the pockets 32 and the electro wire segments 30, a watermark which simulates oxford cloth can be obtained. The recesses and segments may run both circumferentially and longitudinally of the dandy roll and, as in any random arrangement, a number of the recesses 30 and/or electro wire segments 32 may intersect.

The intensity of the watermark can be controlled using conventional technique such as increasing the pressure of the dandy roll on the paper stock or by driving the dandy roll faster than the paper stock.

Having described the invention in detail and by reference to specific embodiments thereof, it will be apparent that numerous variations and modifications are possible without departing from the spirit and scope of the invention as defined by the following claims:

What is claimed is:

1. A dandy roll useful in manufacturing paper having a watermark design which simulates oxford cloth, said dandy roll comprising a cylindrical wire screen mounted upon a cylindrical framework, the mesh of said screen being between 15 and 25, said screen having a plurality of substantially straight electro wire segments soldered to the outer face thereof, said soldered wires being oriented parallel to the wires forming said screen, said screen further having a plurality of substantially straight pockets formed therein, said pockets being formed by removing selected segments of the wires forming said screen, said soldered wires and said pockets being randomly positioned on said dandy roll so as to provide watermarks which simulate the appearance of oxford cloth when said dandy roll is used in papermaking.

2. The dandy roll of claim 1 wherein the wires forming said screen run longitudinally and cylindrically about said dandy roll.

3. The dandy roll of claim 2 wherein said wire screen has a mesh in the range of about 18 to 22.

4. The dandy roll of claim 3 wherein said wire screen is formed from wire ranging from about 0.014 to about 0.020 inch in diameter.

5. The dandy roll of claim 1 wherein said pockets and said electro wires range from about 0.5 to about 2 inch in length.

6. The dandy roll of claim 4 wherein said pockets and said electro wires range from about 0.5 to about 2 inch in length.

7. In a papermaking process which comprises contacting damp paper stock with a dandy roll to form a watermark in said stock, said dandy roll comprising a cylindrical framework having a cylindrical wire screen mounted thereon, the improvement wherein:

the mesh of said screen is between 15 and 25, a plurality of substantially straight electro wires are soldered to the surface of said screen and said screen has formed therein a plurality of substantially straight pockets, said pockets being formed by removing selected segments of the wires forming said screen, said pockets and said soldered wires being oriented parallel to the wires forming said screen and being randomly positioned on said dandy roll so as to provide a watermark which simulates oxford cloth.

8. The papermaking process of claim 7 wherein said wire screen is mounted on said cylindrical framework with its wires running parallel and circumferentially about said dandy roll.

9. The papermaking process of claim 8 wherein said wire screen has a mesh ranging from about 18 to 22.

10. The papermaking process of claim 9 wherein said wire screen is formed from wire ranging from about 0.014 to about 0.020 inch in diameter.

11. The papermaking process of claim 7 wherein said pockets and said electro wires range from about 0.5 to 2 inch in length.

12. The papermaking process of claim 10 wherein said pockets and said electro wires range from about 0.5 to about 2 inch in length.

* * * * *